United States Patent [19]

Woehrle et al.

[11] Patent Number: 4,834,383

[45] Date of Patent: May 30, 1989

[54] TENNIS RACKET WITH EQUAL STRING LENGTHS

[75] Inventors: Maurice Woehrle, Voiron; Dominique Deville, Saint Etienne de Crossey; Gilles Du Gardin, Voiron, all of France

[73] Assignee: Skis Rossignol S. A., Voiron, France

[21] Appl. No.: 96,033

[22] Filed: Sep. 11, 1987

[30] Foreign Application Priority Data

Sep. 11, 1986 [FR] France ..... 86 12955

[51] Int. Cl.[4] ..... A63B 49/02

[52] U.S. Cl. ..... 273/73 C; 273/73 D

[58] Field of Search ..... 273/73 R, 73 C, 73 D, 273/73 F, 73 G, 73 H, 73 K, 73 L

[56] References Cited

U.S. PATENT DOCUMENTS

| | | | |
|---|---|---|---|
| 3,917,267 | 11/1975 | McGrath | 273/73 H |
| 4,332,076 | 3/1982 | Betram et al. | 273/73 D |
| 4,394,014 | 7/1983 | Balaban | 273/73 D |
| 4,512,575 | 4/1985 | Tzeng | 273/73 C |
| 4,662,634 | 5/1987 | Winkler | 273/73 C |

FOREIGN PATENT DOCUMENTS

| | | | |
|---|---|---|---|
| 0171500 | 2/1986 | European Pat. Off. | 273/73 C |
| 3521117 | 10/1985 | Fed. Rep. of Germany | 273/73 D |
| 2450114 | 10/1980 | France | 273/73 D |
| 2455906 | 1/1981 | France | 273/73 D |

*Primary Examiner*—Edward M. Coven
*Assistant Examiner*—William E. Stoll
*Attorney, Agent, or Firm*—Herbert Dubno; Andrew Wilford

[57] ABSTRACT

A tennis racket has an elongated handle defining a longitudinal main axis and having an outer end and an annular frame fixed to the outer handle end and bisected by the axis. The frame has an arcuate crown concave toward the handle and an arcuate throat concave toward the handle and of substantially the same transverse size and curvature as the crown. The crown and throat are formed with respective longitudinally aligned sets of longitudinally throughgoing and transversely spaced holes. In addition the frame has a pair of sides substantially symmetrically flanking the axis and longitudinally bridging the crown and throat. These sides are formed with respective transversely aligned sets of transversely throughgoing and longitudinally spaced holes. The crown and sides together define an oval outer periphery. The side holes open outward at their outer ends into respective outwardly open grooves in the sides of the frame. Main strings extending longitudinally between respective holes of the crown and throat substantially parallel to the axis and cross strings extending transversely generally perpendicular to the axis between respective holes of the sides together define a central spot of predetermined longitudinal length and transverse width. The depth of the groove and of the inner side edge is such that the transverse lengths of the cross strings traversing the spot are all substantially identical between the respective outer and inner hole ends.

5 Claims, 2 Drawing Sheets

TENNIS RACKET WITH EQUAL STRING LENGTHS

FIELD OF THE INVENTION

The present invention relates to a tennis racket. More particularly this invention concerns such a racket having a crowned throat.

BACKGROUND OF THE INVENTION

A standard tennis racket such as described in French Pat. No. 2,455,906 has an elongated handle defining a longitudinal axis and having an inner end provided with a grip and an outer end that forks and that forms the throat of the head of the racket. The head in turn is invariably oval, annular, and bisected by the main longitudinal axis. It carries an array of transversely equispaced longitudinal or main strings and an array of longitudinally spaced cross strings woven and forming a plane with the main strings. The outer periphery of the head is formed with an outwardly open groove in which the strings run, as in reality only a single filament forms all the cross strings and at most one other itself forms all the main strings. This groove protects the strings by recessing them so that they are not damaged if, for instance, the edge of the racket's head is struck on the ground. Typically grommets, eyelets, or the like are used to line the holes in the frame through which the strings pass to reinforce the material of the racket, as there is considerable tension in the strings at all times, and this tension peaks very high when a ball is struck.

In order to give the most even response in the central sweet spot of the racket, where the ball should be struck for most effective response of the racket, it is known to provide a reverse or crowned throat on the frame having a curvature identical to the opposite end or crown of the head and concave toward the handle, like the crown. The longitudinal strings that lie in the sweet spot therefore are all of the same length, measured in the plane of the strings within the inner periphery of the racket, so that they will have substantially the same response.

Although it has been suggested to make the cross strings also of equal length in the sweet spot at least, no practical way of achieving this end has been found. The logical procedure is to make both of the sides, that is the parts of the frame at the head between the crown which is most distant from the handle and the throat which is at the outer end of the handle, straight. This has two main disadvantages: The resultant racket looks so nonstandard as to be unmarketable, and the use of straight sides substantially weakens the racket. Thus a square-sided racket, if it looked good enough to be acceptable, would have to be made very robustly to have the same strength as the inherently stronger oval shape of a standard racket. Such construction would substantially increase the weight of the racket and make it for this reason unusable. If on the other hand some inward bending of the sides were tolerated, the result would actually be a nonuniform response since the bending would be less toward the crown and throat, so that the desired effect would not be achieved.

OBJECTS OF THE INVENTION

It is therefore an object of the present invention to provide an improved racket.

Another object is the provision of such a racket which overcomes the above-given disadvantages, that is which has uniform response in both its main and cross strings while having a standard appearance and strength.

SUMMARY OF THE INVENTION

The racket according to the invention has, as is known, an elongated handle defining a longitudinal main axis and having an outer end and an annular frame fixed to the outer handle end, substantially bisected by the axis. The frame has an arcuate crown concave toward the handle and substantially bisected by the axis and an arcuate throat concave toward the handle, substantially bisected by the axis, and of substantially the same transverse size and curvature as the crown. The crown and throat are formed with respective longitudinally aligned sets of longitudinally throughgoing and transversely spaced holes. In addition the frame has a pair of sides substantially symmetrically flanking the axis, having confronting inner peripheries, and longitudinally bridging the crown and throat. These sides are formed with respective transversely aligned sets of transversely throughgoing and longitudinally spaced holes having inner ends at the inner peripheries and outer ends. The crown and sides together define an oval outer periphery. The side holes open outward at their outer ends into respective outwardly open grooves in the sides of the frame. Main strings extending longitudinally between respective holes of the crown and throat substantially parallel to the axis and cross strings extending transversely generally perpendicular to the axis between respective holes of the sides together define a central spot of predetermined longitudinal length and transverse width. According to the invention the depth of the groove at the outer ends of the holes are such that the transverse lengths of the cross strings traversing the spot are all substantially identical between the respective outer hole ends.

According to another feature of this invention the inner edges of the sides at the inner ends of the holes are shaped such that the transverse lengths of the cross strings traversing the spot are all the substantially identical between the respective inner hole ends.

With the system of this invention, therefore, all of the cross strings will have the same length and, therefore since they are all formed of the same uniform filament, the same elasticity, strength, beat frequency, and so on, like the longitudinal strings in the central spot. As a result any ball deflected from anywhere within this spot will be rebounded accurately with no vibrations in the racket.

In accordance with a further feature of this invention the sides have straight inner edges at which the respective inner hole ends open at least transversely across from the spot and the grooves have straight floors at which the respective outer hole ends open at least transversely across from the spot. Thus the cross strings traversing the spot are all of substantially the same length between the inner hole ends and also between the outer hole ends. The alternate system according to this invention, one that would be somewhat difficult to make, would have the groove simply formed extra deep at the holes and/or the inner peripheries of the sides being built up just around the inner ends of the cross-string holes.

The spot according to this invention corresponds to the so-called central sweet spot of the racket. In addition the holes are provided with lining grommets through which the respective strings pass. The inner edges and the groove floors are substantially planar and parallel to the axis.

DESCRIPTION OF THE DRAWING

The above and other objects, features, and advantages will become more apparent from the following, reference being made to the accompanying drawing in which.

SPECIFIC DESCRIPTION

Figure 1:
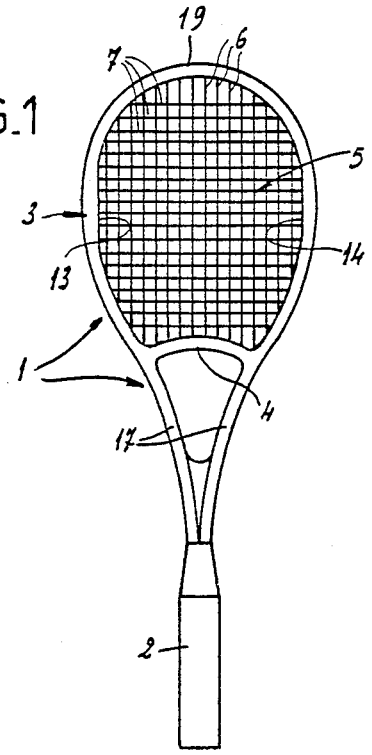
FIG. 1 is a small-scale front view of the racket according to this invention.
Figure 3:
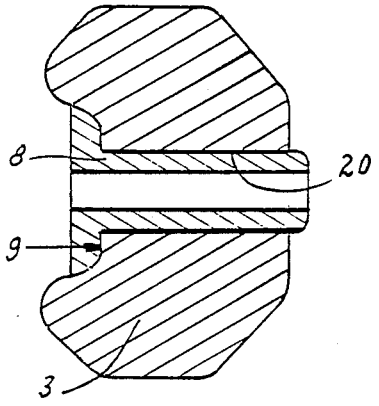
FIGS. 3 and 4 are sections taken respectively along lines III—III and IV—IV of FIG. 2.
Figure 4:
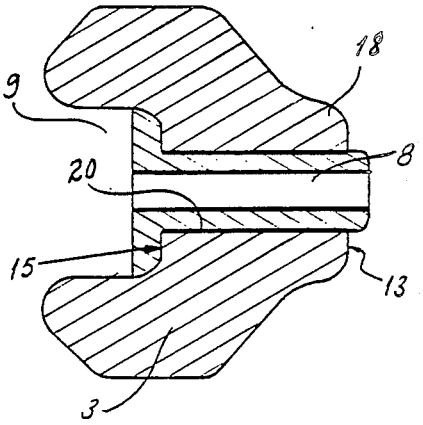
Figure 2:
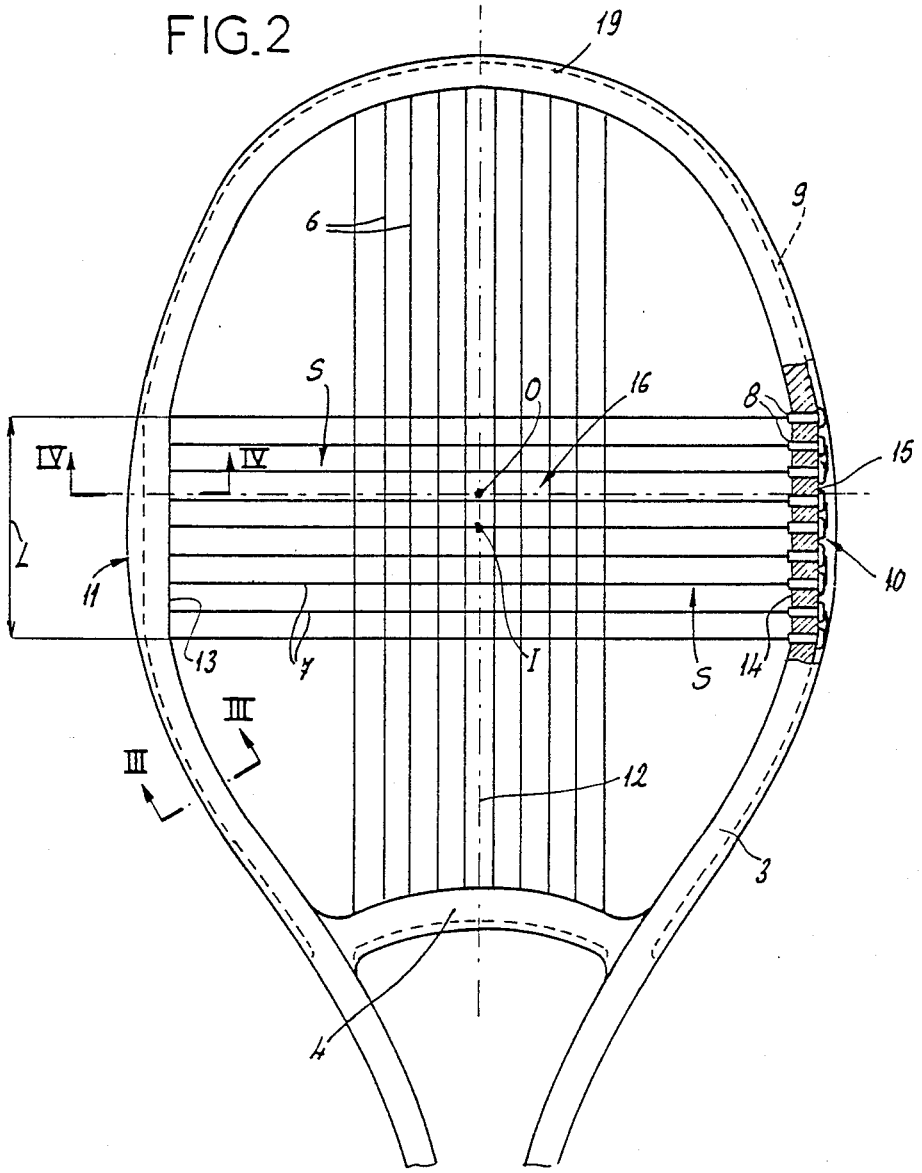
FIG. 2 is a larger-scale and partly sectional view of the head part of the racket of the present invention.

As seen in FIGS. 1 and 2 a tennis, squash, or badminton racket 1 according to the invention has a handle forming a grip 2 and defining a longitudinal axis 12 and having an outer end 17 that is forked and that carries a head frame 3 bisected by the axis 12 and carrying a net 5 woven of longitudinal strings 6 and cross strings 7. As is well known the head 3 has an arcuate crown 19 and an identically arcuate throat 4 so that the longitudinal filaments 6 are of the same length throughout a central region 16 known as the sweet spot. In addition the head 3 has, except where it is joined to the handle 17, an oval external periphery formed with an outwardly open groove 9 and is formed with throughgoing holes 20 provided with identical liner grommets 8 through which the strings 6 and 7 pass. As is standard, the strings 6 and 7 are actually formed by only one or two filaments which have bights in the grooves 9 between the holes 20.

Whereas in a prior-art such racket the groove 9 would have a floor of the same oval shape as the outside of the head of the racket, and the inner periphery of the head 3 would be parallel to its outer one, according to this invention the side central regions 10 and 11 of the racket are differently formed. They have internal ridges forming flat inner faces 13 and 14 extending parallel to the axis 12, and the groove 9 has on each side 10 and 11 a flat and straight floor 15 extending parallel to the axis 12 also. Thus the holes 20 are of identical length at these sides 10 and 11 and the cross strings 7 are also of identical length in the sweet spot 5. At the same time the inwardly projecting and straight ridge 18 compensates for the material lost to the groove 9 which is fairly deep at the center of each side 10 or 11. As a result the sides 10 and 11 will be of virtually perfectly uniform stiffness and elasticity.

Since the strings 6 and 7 are all of the same length in the sweet spot 16 they will vibrate at the same frequency and will in fact act synchronously and identically. They therefore act together to enormously increase the ultimate rebound achievable. In the illustrated arrangement the sweet spot 16 has an overall length L parallel to the axis 12 and its center is at I. Thus with the uniform-response system of this invention a ball that strikes slightly outward of this center I, at O, will still rebound identically as if hit perfectly on center and will not cause the racket to vibrate.

We claim:

1. A racket comprising:

an elongated handle defining a longitudinal main axis and having an outer end;

an annular frame fixed to the outer handle end, substantially bisected by said axis, and formed with an arcuate crown concave toward the handle and substantially bisected by said axis, an arcuate throat concave toward the handle, substantially bisected by said axis, and of substantially the same transverse size and curvature as the crown, the crown and throat being formed with respective longitudinally aligned sets of longitudinally throughgoing and transversely spaced holes, a pair of generally inwardly concave sides substantially symmetrically flanking said axis, having confronting inner peripheries, and longitudinally bridging the crown and throat, the sides being formed with respective transversely aligned set of transversely throughgoing and longitudinally spaced holes having inner ends at the inner peripheries of said sides, the crown and sides together defining an oval outer periphery, and respective outwardly open grooves in the sides of the frame, the respective holes opening outward at their outer ends into the grooves, main strings extending longitudinally substantially parallel to said axis between respective holes of the crown and throat substantially parallel to said axis; and cross strings extending transversely generally perpendicular to said axis between respective holes of the sides, the cross and main strings together defining a central spot of at least three of said main strings and at least three of said cross strings the depth of the groove at the outer ends of the holes being such that the transverse lengths of the cross strings traversing said spot are all substantially identical between the respective outer hole ends.

2. The racket defined in claim 1 wherein the spot corresponds to the central sweet spot of the racket.

3. The racket defined in claim 1 wherein holes are provided with lining grommets through which the respective strings pass and all substantially identical.

4. The racket defined in claim 1 wherein the inner edges of the sides in the region of said spot are substantially planar and parallel to the axis.

5. The racket defined in claim 1 wherein the groove floors are substantially planar and parallel to the axis.

* * * * *